United States Patent [19]

Golden

[11] Patent Number: 4,572,351

[45] Date of Patent: Feb. 25, 1986

[54] TRANSFER UNIT

[75] Inventor: Michael D. Golden, Costa Mesa, Calif.

[73] Assignee: General Dynamics Pomona Division, Pomona, Calif.

[21] Appl. No.: 93,729

[22] Filed: Nov. 13, 1979

[51] Int. Cl.[4] ..... B65G 47/24; F41D 10/22

[52] U.S. Cl. ..... 198/412; 89/33.16; 198/457; 198/594; 198/624

[58] Field of Search ..... 89/33 BB, 33 B, 33 BA, 89/33 BL, 33 E; 198/457, 608, 624, 563, 408, 412, 594

[56] References Cited

U.S. PATENT DOCUMENTS

| | | | |
|---|---|---|---|
| 1,492,275 | 4/1924 | Thompson | 198/608 |
| 1,492,276 | 4/1924 | Thompson | 198/608 |
| 2,122,423 | 7/1935 | Joyce | 89/33 BA |
| 2,391,888 | 1/1946 | Elliott | 89/33 BB |
| 2,483,334 | 9/1949 | D'Assis-Fonseca et al. | 89/33 BB |
| 2,584,473 | 2/1952 | Krueger | 198/608 |
| 3,060,809 | 10/1962 | Tschumi | 89/33 BC |
| 3,090,476 | 5/1963 | Sanders . | |
| 3,101,830 | 8/1963 | Webster . | |
| 3,319,524 | 5/1967 | Tassie . | |
| 3,472,722 | 10/1969 | Hutchinson | 198/563 |
| 3,618,454 | 11/1971 | Christenson | 89/33 BB |
| 3,670,863 | 6/1972 | Meier et al. | 89/33 BC |
| 3,901,123 | 8/1975 | Jayne et al. | 89/33 C |

FOREIGN PATENT DOCUMENTS

| | | | |
|---|---|---|---|
| 871141 | 4/1942 | France | 89/33 BB |

OTHER PUBLICATIONS

Lars G. Soderholm, "Three-Axis Gun Mount Tracks Low-Level, High Speed Aircraft," Design News, vol. 15, No. 14, Jul. 4, 1960, p. 6.

*Primary Examiner*—Stephen C. Bentley

*Attorney, Agent, or Firm*—Henry M. Bissell; Edward B. Johnson

[57] ABSTRACT

A transfer unit for serial re-orientation of plural items comprising an item supply train and a rotatable drum within a cylindrical housing. The items are provided serially to an inlet to the housing by a chain ladder or other mechanical means, and are longitudinally and axially re-oriented in the housing for transfer out of the housing. The drum is rotatable about its axis to provide further re-orientation of the items. All internal components of the rotatable drum are synchronously driven by mechanical means, and positive mechanical control of the serially supplied items is maintained at all times.

34 Claims, 13 Drawing Figures

TRANSFER UNIT

BACKGROUND OF THE INVENTION

1. Field of the Invention

The present invention relates to apparatus for the re-orientation of a plurality of serially supplied items. More particularly, the presently disclosed apparatus is directed to the re-orientation of shells being fed from a stationary magazine to a gun which is variable in angle of elevation.

2. Summary of the Prior Art

There are many needs in industry as well as in the military for re-orientation of serially provided items or units. One particular use has been the provision of shells to rapid fire guns. Another use is in the canning and bottling industries, for instance, where cleaning, drying, filling, sealing, and labeling must be effected, and where such steps oten require re-orientation of a can or bottle.

In the weaponry area, technology has progressed from Gatling guns to numerous types of equipment including the development of "linkless" supplies of ammunition. One exemplary linkless system is disclosed by J. R. Christenson in U.S. Pat. No. 3,618,454. Christenson provides for a plurality of sprockets positioned on shafts that are gear driven to supply ammunition to a gun, and to return used cartridges and misfired cartridges to a separate storage area. This type of unit does not, however, provide for easy re-orientation of the position of the gun barrel in relation to the shell supply source. The result is limited motion capabilities in the gun, or great loss in space due to increased supply area requirements.

Tassie in U.S. Pat. No. 3,319,524 discloses re-orientation structure of linkless cartridges. All of the sprockets utilized by Tassie lie in a relatively planar relationship and, as a result, the cartridge is rotated along a flat plane keeping the rear of the cartridge relatively fixed and rotating the forward end over a large arc. While this accomplishes re-orientation along one plane, it necessitates the provision of a relatively large transfer unit due to its planar configuration. The fact that most of the gear train utilized to rotate the shells is provided externally to the shells also necessitates a wide flat structure. Additionally, elevational re-orientation during firing can only be effected by motion of the whole of the transfer unit, and thus further expensive and complex gearing is necessary to provide a complete unit.

Another approach utilized to re-orient shells is disclosed in U.S. Pat. No. 3,901,123 of Jayne et al. In this system, end loading is required, and the shells are transferred through a housing to the rear of the gun. The shells travel perpendicular to the gun barrel until just before loading, then are rotated on a plate. This type of system, obviously, is not suitable for systems utilizing more conventional side loading, and does not allow for rapid fire as only one shell is rotated on the plate at a time.

In the bottling industry, systems such as a cam operated lever disclosed in U.S. Pat. No. 3,101,830 of Webster have been utilized. This type of system, however, depends on a track and is limited to a single 90 degree orientation without considerable further equipment. Sanders, on the other hand, in U.S. Pat. No. 3,090,476, utilizes a conical structure that accepts bobbins in a horizontal position, and rotates to release them in a vertical position. While quite simple, the system utilizes a gravity feed which could be deleterious to the surfaces of the items being handled, and utilizes a fixed conical structure, which, for example, is not easily adapted to feed a plurality of conveyor lines.

Thus, it appears that there is a definite need in the art to provide a material transfer unit capable of re-orienting individual items about a first axis, and even to provide them with a capability of rotating about a second axis without disturbing either the supply of the items, or the function of the re-orientation system. It is further desirable in some applications to be able to drive the transfer unit in either direction.

SUMMARY OF THE INVENTION

The transfer mechanism of the present invention incorporates, for example, a linkless guide and belt system to provide cartridges or shells to the transfer mechanism for re-orientation and eventual firing from a gun. After the shells are provided from a magazine on a linkless chain ladder the ladder then returns to the magazine. The chain ladder is usually endless, but may be of any desired design. The transfer mechanism itself includes a rotatably cylindrical unit with a first pair of input shafts parallel to each other and parallel to the longitudinal axis of the shell to be re-oriented. Sprockets, designed for use herein, are provided on the shafts. The sprockets have shaped indentations for mating with the shell or other item being transferred. The item first comes in contact with the sprockets on the first of the two parallel input shafts, and then contacts a guide or sprocket on the second shaft. The shafts rotate synchronously to guide the shell downward between the shafts. The first shaft has two spaced-apart sprockets while the second shaft generally has only one sprocket which is positioned opposite one of the first shaft sprockets. A guide is provided adjacent the second of the first shaft sprockets. Immediately below the first set of shafts and sprockets is a parallel pair of third and fourth sprocketed shafts oriented at an angle of up to 45 degrees relative to the first and second shafts. At one end of the unit (normally the projectile end when dealing with armament) the article being re-oriented next comes in contact with the third shaft sprocket, followed by the fourth shaft sprocket. The other end of the shell contacts the fourth shaft inner sprocket first, due to the orientation of the shafts. The fourth shaft inner sprocket then moves the rear of the shell toward the third shaft, re-orienting it about an axis at or near the center of the shell, prior to the next step. In the next step fifth and sixth shafts, which are positioned at an angular orientation to the the third and fourth shafts, perform the same function as the third and fourth shafts. Finally, after this second re-orientation, a third re-orientation can be effected by seventh and eighth shafts. The projectile end of the shell first contacts the sprockets on the seventh shaft, and then contacts the sprockets on the eighth shaft as it exits the unit. The other end of the projectile contacts only a guide structure and an eighth shaft sprocket to complete the re-orientation.

In this exemplary structure, the second pair of shafts would rotate the shell 30 degrees about its axis at a point at or near the center of the shell, the third set would rotate the shell about the same axis another 30 degrees for a total of 60 degrees. Then, the third 30 degree rotation would be peformed by the fourth set of shafts and related sprockets, for a total rotation or re-orientation of 90 degrees. In this exemplary form, each shell is rotated essentially underneath the subsequently supplied shell, when the transfer structure of the present invention is relatively vertical, and thus space requirements are at a minimum.

Each of the shafts is driven through a gear train mounted on an external support frame. The gear train is arranged with large ring gears positioned on either end of the cylindrical unit, one of which drives the first shaft, which in turn drives the second shaft at the same speed of rotation. The first shaft, additionally, drives the fourth shaft since the angular orientation of the shafts places one end of the fourth shaft directly under the first shaft at a point where the gearing will not interfere with the transfer of the shells. At the other end of the fourth shaft, gears are provided on the third and fourth shafts to drive the third shaft. Another gear is provided on the third shaft to drive the sixth shaft, since this gear drive, like the drive between the first and the fourth shafts, is positioned away from the shell at the point where the third and sixth shafts are vertically aligned. The sixth shaft may be used to drive the fifth shaft at either end thereof, but it is preferable to drive it at the same end as the transfer from the third shaft to the sixth shaft, as this orientation is spaced away from the shells. The fifth shaft drives the eighth shaft, for example at the same end, which then drives the seventh shaft at the opposite end. As a result, there is continuous driving of each of the shafts at the proper rotation to provide continous flow of the items being transferred. Spur gears are used where the drive and driven shafts are parallel and helical gears are used when the shafts are not parallel.

In the most preferable form, drive to the series of shafts in the transfer unit is provided by a hydraulic motor mounted adjacent to and driving a spur gear meshed with one of the aforesaid ring gears. The ring gears perform an additional function by having an external toothed surface which engages the chain ladder that retains the shells to be transferred. Thus a continuous supply of shells from the magazine to the transfer unit is assured, as direct synchronized gearing is provided both to supply shells to the transfer unit and to drive the unit.

The whole unit, including all of the gearing, the shafts, the sprockets, the ring gears, and the necessary support and structural components for positioning all of the shafts, is mounted in a series of bearings positioned around the external portion of the ring gears supporting the unit and positioning it relative to a fixed portion of a housing. In this manner, the unit, including the ring gears and all of the parts driven thereby, may be rotated to adjust for changes in elevation of the associated gun. As will be described hereinafter in more detail, this is effected by a torsional linkage between the gun housing in an area where elevation is effected and, preferably, is end plate mounted inside one of the ring gears of the transfer unit. In this manner, when the gun is elevated or depressed and no firing occurs, the system can be driven either in the forward direction or in the reverse direction by the rotation of the unit itself, if needed, in order to take up any slack, or provide extra shells as needed. This function assures a continuous shell supply.

In order to properly provide the structure in accordance with the present invention, certain specific parameters must be dealt with. The system is designed, as hereinbelow described in more detail, by considering the feed rate, the amount of re-orientation to occur, and space considerations. Generally, however, re-orientation of from 0 to 45 degrees can be effected with the present system in each step thereof, and thus, orientation in 90 degrees can be effected by 6 shafts as opposed to the 8-shaft design above. In addition, if design factors indicate it, more steps could be taken, or the re-orientation could be to an angle other than 90 degrees from the original orientation. Additionally, due to the chain ladder and the rotatable cylindrical transfer unit, a second re-orientation, in a plane perpendicular to the first re-orientation, can be effected up to approximately 350 degrees. That is, the rotation of the unit, as previously described, may be almost a complete circle, the limiting factors being the need for sufficient room to supply the unit and the necessary structure to position the feed adjacent the first set of shafts.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
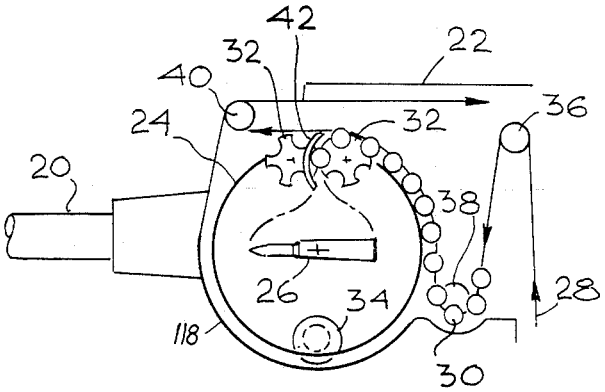
FIG. 1 is a schematic showing the transfer unit of the present invention attached to a gun in a horizontal firing orientation.

In FIG. 1, and all the figures herein, the invention is illustrated as used with a gun. However, it is equally applicable to the transfer, for instance, of bottles or other items, usually of an elongate character, in a serial manner.

Figure 2:
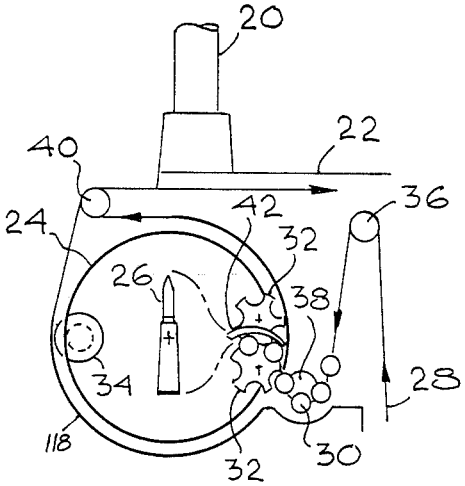
FIG. 2 shows the schematic of FIG. 1 in a vertical firing orientation.

In FIGS. 1 and 2, the gun housing, indicated generally as 22, has transfer unit 24 attached to the barrel 20 through a torsional mounting structure (not shown). In FIG. 1, the gun barrel 20 is shown in the fully depressed or relatively horizontal position, and the outlet of the transfer unit positions shell 26 horizontally for immediate loading. In FIG. 2, gun barrel 20 is fully elevated and almost vertical, and the transfer unit 24 has rotated to provide shells 26 to the gun in the proper relationship to the gun, i.e. parallel to the axis of the barrel of the gun. Feed to the transfer unit is effected by the motion of chain belt 28 which carriers shells 30 for entry into the housing of transfer unit 24. As shown in FIG. 1, shells 30 enter transfer unit 24 at the top of the unit when the gun barrel is horizontal, but when the barrel is rotated to the relatively vertical position, the internal portions of the transfer unit 24 have rotated, as shown by the different positions of sprockets 32, and the shells are then provided at the rear of the unit.

Chain belt 28 supplies shells to the transfer unit by being drawn over it by teeth provided in a pair of large ring gears described hereinbelow, which pull chain 28 over sprocket or pulley 36, around sprocket or pulley 38 and to transfer unit 24, where the shells are separated from the chain. The chain continues traveling around the transfer unit, around exit sprocket or pulley 40, and travels back to a magazine when an endless chain is utilized. As is more clearly shown in the subsequent figures, shells 30 contact sprockets 32 on one end of the shell, but only contact one of the sprockets at the opposite end, being held in place by guide bar 42 at this end. In this manner the transfer unit of the present invention provides continuous re-orientation of the shells along an axis perpendicular to the elevational plane of the gun and also rotates the shells about their central axis in a manner such that they are provided to the gun in a parallel relationship to it, irrespective of its elevation.

Figure 3:
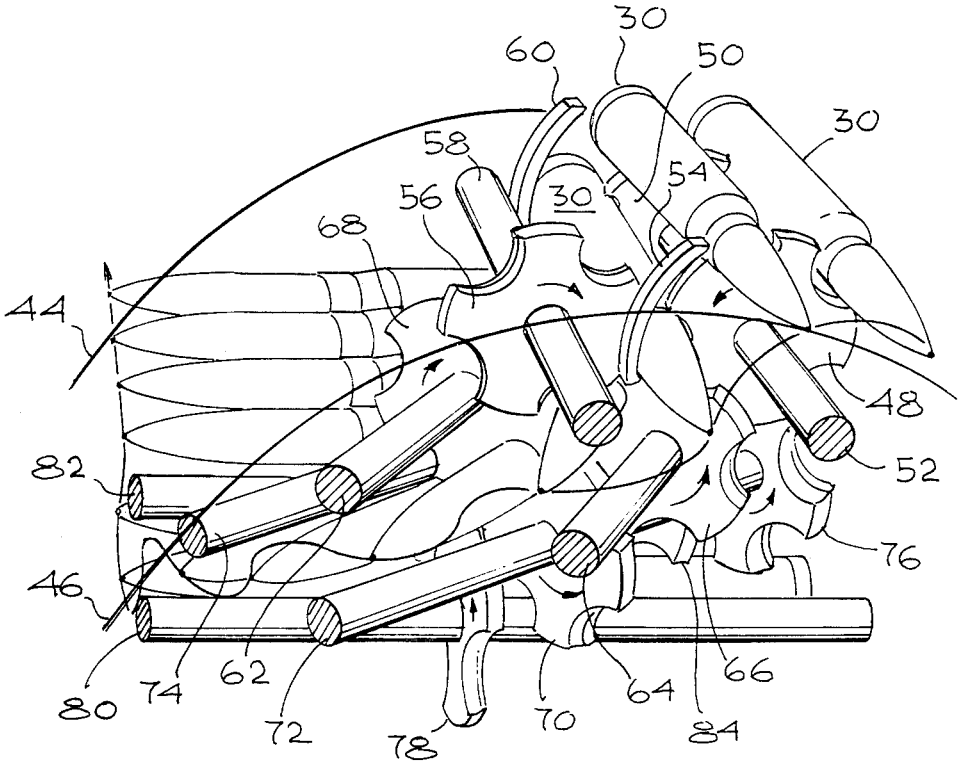
FIG. 3 is a schematic sectional drawing of a preferred embodiment showing 90 degree re-orientation of shells.

The schematic drawing in FIG. 3 shows the internal structure utilized for 90 degree rotation of the shells. In the schematic shells 30 enter the transfer unit at the upper right of the figure. The ring gears, previously noted, are generally shown by lines 44 and 46. The shells are positioned on outboard sprocket 48 and inboard sprocket 50 which are fixed to first rotating shaft 52. The projectile end of the shell is held in place by guide 54 prior to contacting outboard sprocket 56 on second shaft 58. Second shaft 58 does not have an inboard sprocket, and thus the casing end of shell 30 is positioned by guide 60. Shaft 58 is driven by a spur gear which meshes with a spur gear on shaft 52. Shaft 52 itself is driven by another spur gear (not shown) which meshes with ring gear 44. Of course, the shafts are appropriately supported in end plates which are not shown in this drawing for sake of clarity. Since second shaft 58 is driven by first shaft 52, as first shaft 52 rotates in a counterclockwise direction, second shaft 58 rotates in a clockwise direction. As a result the shell 30 is pulled down between sprockets 48 and 56 at one end, while guide 60 holds shell 30 in contact with inboard sprocket 50 at the other end. Third shaft 64 is at an angle of 30 degrees to a vertical plane drawn along the axis of first shaft 52, and fourth shaft 62 is parallel to third shaft 64. The result is that fourth shaft 62 passes underneath first shaft 52 at a point inboard of the end casing of shell 30. The inboard sprocket (not shown) on fourth shaft 62 then comes into contact with shell 30 prior to the inboard sprocket (not shown) on third shaft 64. On the inboard end, shell 30 is released from sprocket 50 and guide 60 upon contact with a sprocket (not shown) on fourth shaft 62. At the projectile end, however, shell 30 contacts sprocket 66 on third shaft 64 first, and then contacts sprocket 68 on fourth shaft 62. The projectile end of shell 30 is thus held in place, at the outboard end, by outboard sprocket 66 on third shaft and outboard sprocket 68 on the fourth shaft in the orientation shown. In the next step, a second 30 degree re-orientation is effected by the shell contacting outboard sprocket 70 on fifth shaft 72, which then guides the shell to contact with an outboard sprocket (not shown) on sixth shaft 74. At the casing end, due to the repeating of the 30 degree re-orientation of shafts 72 and 74, with respect to shafts 62 and 64, shell 30 first contacts an inboard sprocket (not shown) on sixth shaft 74 and then contacts inboard sprocket 76 on fifth shaft 72. Lastly, the final 30 degree rotation is effected by the projectile end of the shell contacting outboard sprocket 78 on seventh shaft 80, and then an outboard sprocket (not shown) on eighth shaft 82. The casing end of the shell is positioned by a guide (not shown) in such a manner that an inboard sprocket is not provided on seventh shaft 80, and the shell immediately contacts inboard sprocket 84 on eighth shaft 82. Shafts 80 and 82 also produce a 30 degree re-orientation relative to shafts 72 and 74, and thus the casing end of projectile 30 is again rotated 30 degrees, so that 90 degrees of rotation are completed.

In operation, then, the projectile end of shell 30 contacts outboard sprocket 48 and then outboard sprocket 56, is lowered to contact outboard sprocket 66 and then outboard sprocket 68, is then lowered again to contact outboard sprocket 70 and an outboard sprocket on sixth shaft 74 (not shown), and, finally, is lowered to contact outboard sprocket 78 and a final outboard sprocket (not shown) on shaft 82. On the inboard, or casing end of the shells, the shell contacts sprocket 50 on first shaft 52, is guided downward by guide 60, and next contacts a sprocket (not shown) or fourth shaft 62. During this transition the inboard end of the shell 30 has rotated about the center of the shell toward shaft 64 to contact an inboard sprocket (not shown) thereon and thus has completed the first rotation. Next, the inboard end of the casing contacts a sprocket (not shown) on sixth shaft 74, having been rotated a second 30 degrees to contact inboard sprocket 76 on shaft 72, and is guided downward and rotated to contact with sprocket 84 on eighth shaft 82. In this manner the axial rotation over 90 degrees is completed, and the shells are then guided out of, or removed from transfer unit 24 by other means, not shown.

Figure 4:
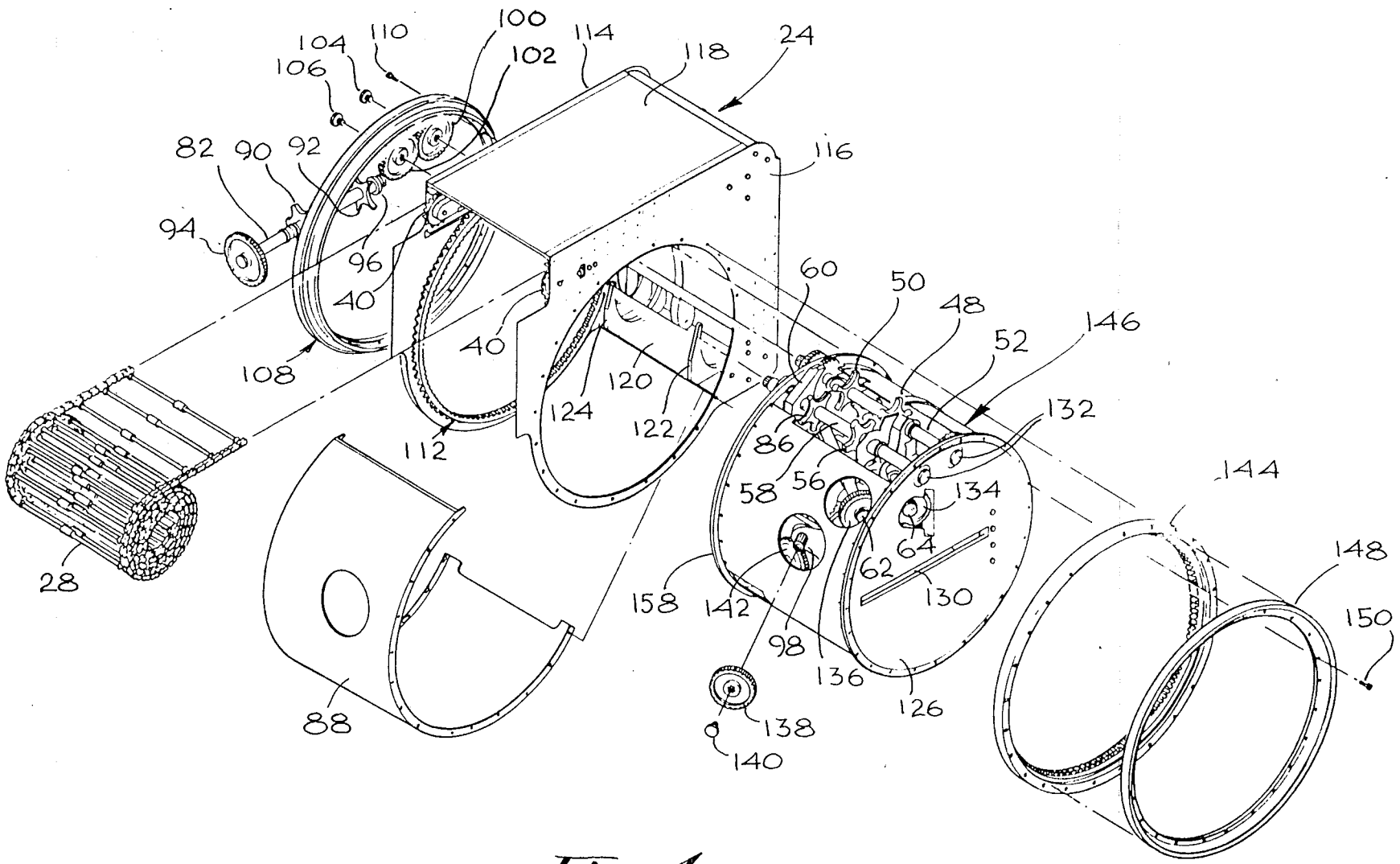
FIG. 4 is an exploded view of the transfer unit showing the major components.

In FIG. 4, only part of the internal structure described in FIG. 3 is shown. In this figure, first shaft 52 is related outboard and inboard sprockets 48 and 50, respectively, are shown, as are the ends of third shaft 64 and fourth shaft 62. In this view optional additional second shaft inboard sprocket 86 is shown, as is inboard shell guide 60. Housing 118 forms a casing to cover and protect the shells on the upper and posterior sides, and includes additional cover 88 which surrounds the internal portions of the transfer unit. Linkless chain belt 28 is shown in a rolled up condition, after removal from exit pulleys 40. At the left end of the drawing, eighth shaft 82 and its outboard sprocket 90 and inboard sprocket 92 are shown removed from the main unit and provided with drive gear 94 and retaining bearing or bushing 96. Eighth shaft drive gear 94 would, if positioned, mesh with seventh shaft driven gear 98 shown in the aperture in the unit. Additionally, first shaft drive gear 100, and second shaft driven gear 102, meshed therewith, are shown at the left end of the drawing, with their mounting bolts 104 and 106, respectively. Large ring bearing support member 108 is bolted to inboard end plate 158 by bolts 110, and forms the inner bearing surface for inboard ring gear 112 which is rotatable, as hereinafter described. Inboard cover plate 114 and outboard cover plate 116 cooperate with cover 88 to form housing 118, and to provide mounting structures for exit sprockets or pulleys 40, and inlet sprockets or pulleys (not shown). Support member 120 is provided with guides 122 and 124 which position the shells upon entry into the housing of the transfer unit. Outboard end plate 126 and inboard end plate 128 contain mounting structures for the eight shafts, as can be more clearly seen in FIGS. 6 and 7. Outboard end plate 126 is also provided with access aperture 130 and shaft mounting apertures 132 as shown in this figure. The functioning of the gear train including third shaft driven gear 134, fourth shaft drive gear 136, sixth shaft drive gear 138, and its mounting bolt 140, along with seventh shaft driven gear 142 are described in more detail in FIG. 8. Outboard ring gear 144 is connected to the remainder of the transfer unit through a bearing surface provided by bearing support 148 which is bolted to the end plate by bolts 150, and connects to the internal portion of the transfer unit 146 through a gear train (not shown).

Figure 5:
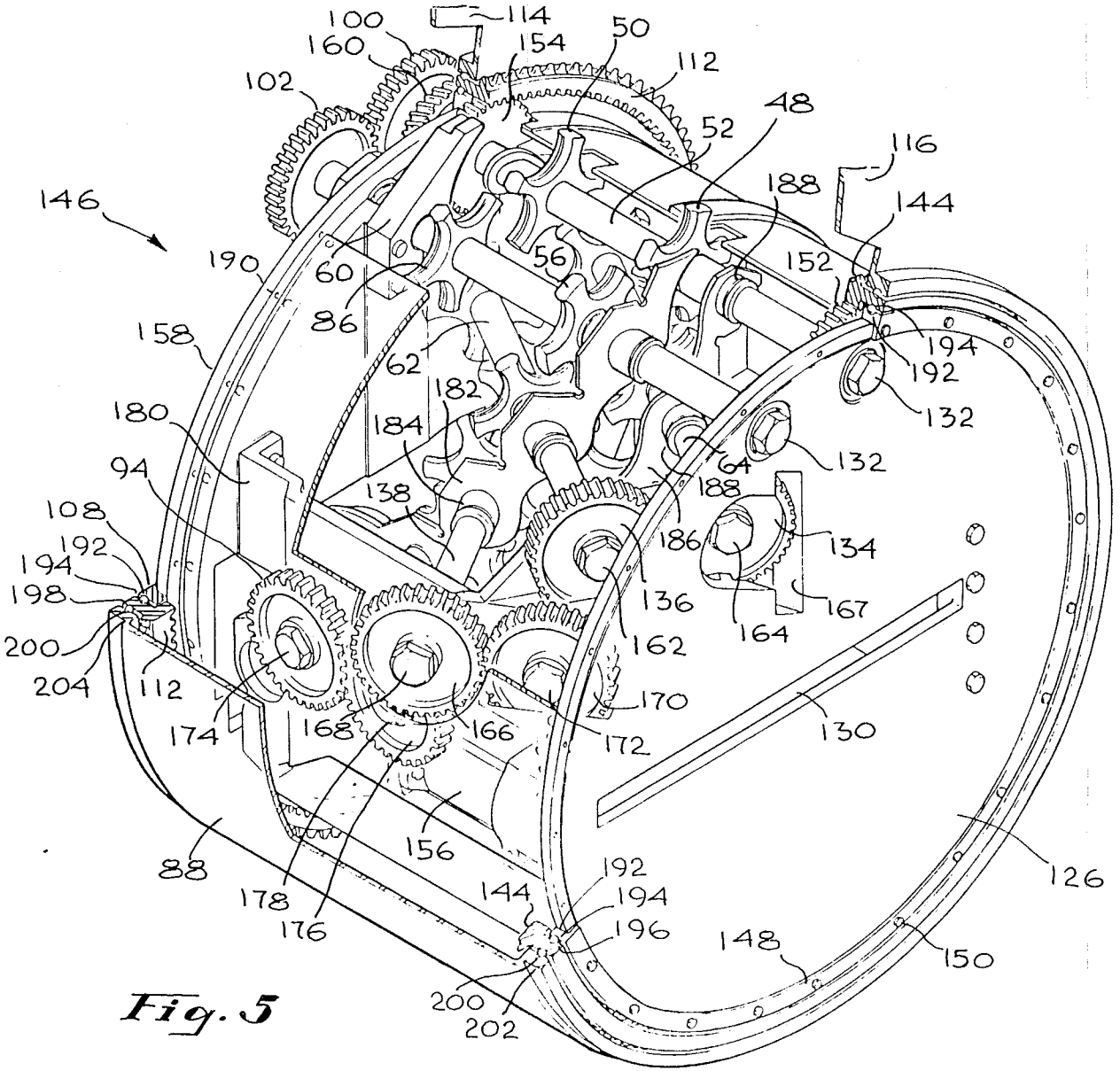
FIG. 5 is a detailed drawing of the internal re-orienting shafts and related gear train.

In FIG. 5, portions of housing 118, including cover 88, which is partially in section, and cover plates 114 and 116, which are also in section, are shown. The internal portion of the transfer unit indicated generally by 146 is shown in more detail, including first shaft mounting bolt 132 on outboard end plate 126, outboard sprocket 48, and inboard sprocket 50. First shaft 52 is the main drive shaft for the internal shaft and sprocket system, and, as shown, is provided with gears 152 and 154. Ring drive gears 152 is meshed with and drives outboard ring gear 144, while inboard ring driven gear 154 is meshed with and driven by inboard ring gear 112, which, in turn, is driven by a hydraulic motor, shown partially hidden at 156. First shaft drive gear 100 drives second shaft driven gear 102 and both are positioned inboard of inboard ring gear 112 and inboard end plate 158. Additional first shaft drive gear 160 is used for helical drive of fourth shaft 62 through a second helical gear (not shown). Fourth shaft drive gear 136, positioned on the shaft by the bolt 162 drives third shaft driven gear 134 which is attached to third shaft 64 by bolt 164. Access aperture 167 is provided in outboard end plate 126 for access to third shaft 64. On the inboard end, sixth shaft 138 is driven by a helical gear (not shown) which meshes with a gear (also not shown) on third shaft 64 and has on its outboard end drive gear 166 which is positioned by bolt 168. Sixth shaft drive gear 166 drives fifth shaft driven gear 170 which is attached by bolt 172 to the fifth shaft (not shown). Eighth shaft drive gear 94 is positioned by bolt 174, and drives seventh shaft driven gear 176, positioned by bolt 178. All of the spur gear mountings for the bottom three parallel pairs of shafts are positioned external to outboard end plate extension 180 but may be located elsewhere, if desired. Outboard guidance of the projectile end of the shell on the second, fourth, sixth and eighth shafts is provided by continuous guide 182 positioned by sleeves 184. Outboard guidance along first, third, fifth and seventh shafts is provided by guide 186 positioned by equivalent sleeves 188.

The whole of the rotatable mounted unit, including the end plates, the supports, and all of the shafts, guides and sprockets are positioned in the housing by ring gear support member 108 on the inboard side, and support member 148 on the outboard side. The support members are bolted to end plates 158 and 126, respectively, through bolts 150 (FIG. 4), and are provided, on their outside edges, with ball bearing support recesses 192. Bearings 194 contact surfaces 196 and 198, respectively, of outboard support ring 148, and inboard support ring 108. In this form the end plates and related internal structure may rotate independently of ring gears 112 and 144, if the motor is allowed to freewheel; alternatively, if the motor is not freewheeling, the structure will rotate with the ring gears. Ring gear 112 is driven by motor 156, and, in turn, drives gear 154 on first shaft 52 to provide the necessary rotation in each and every one of the transfer unit's eight internal shafts. This organization allows for the appropriate motion of the eight shafts, independent of the other functions of the unit.

Additionally, in order to provide the second manner of orientation, as shown in the variations of the gun elevation in FIGS. 1 and 2, a second set of bearing surfaces is provided on outboard ring gear 144 and inboard ring gear 112 to position bearings 200 and provide for contact with housing cover 88 and cover plates 114, 116 at outboard lip 202 and inboard lip 204. Inboard end plate 158 is positively attached to a portion of the gun, or other equipment, which rotates, and the provision of the external set of bearings thus allows for rotation of the internal portions of transfer unit on this second independent axis.

Figure 6:
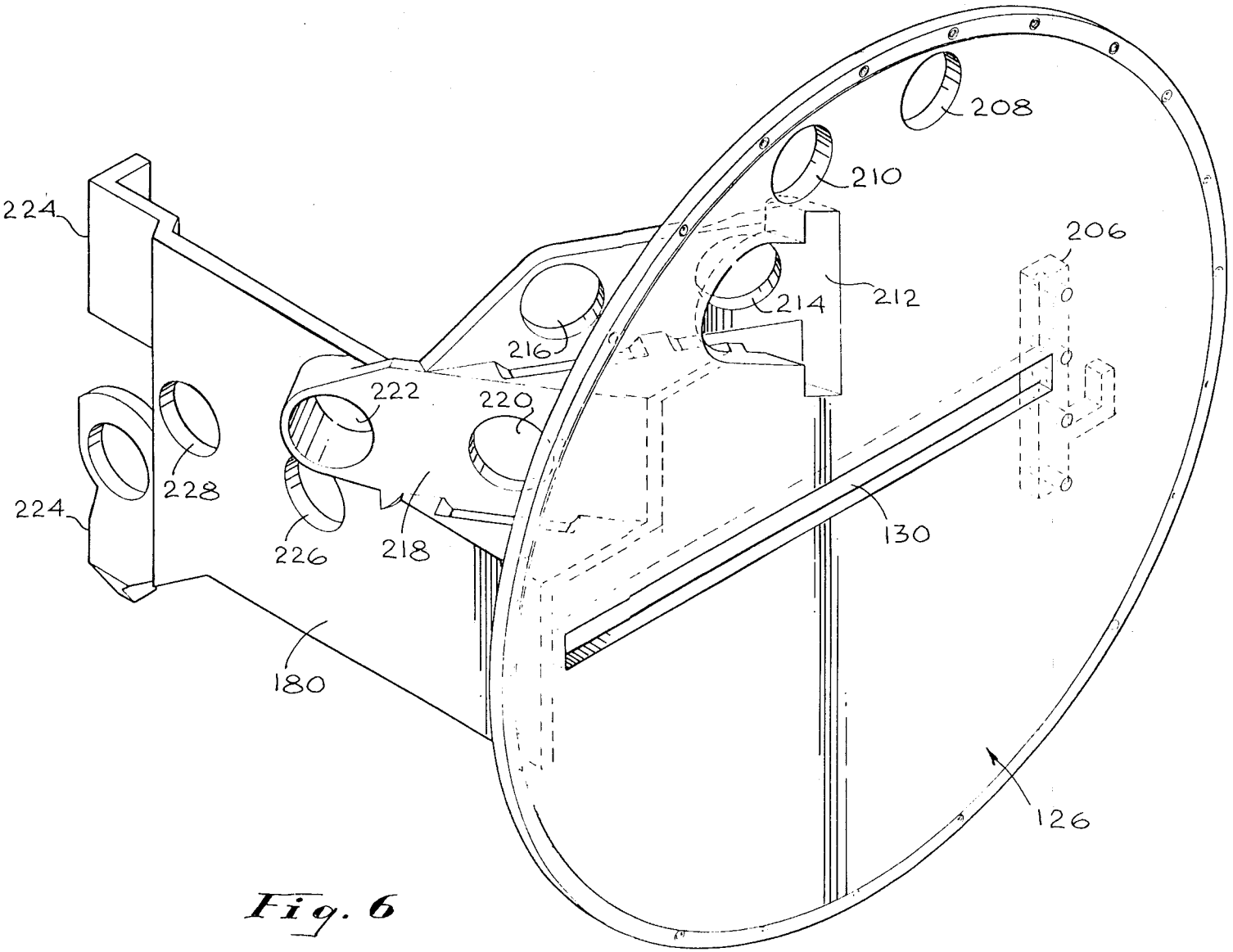
FIG. 6 is an isometric view of the outboard end plate of FIG. 5, looking inward.

FIG. 6 shows outboard end plate 126 with its related access aperture 130 and inboard end plate mounting structure 206. The isometric view is of the outboard plate and the support structure showing, in particular, apertures 208 and 210 for the first and second shafts, respectively. Extension 212 is at an angle of 30 degrees to the surface of end plate 126, and thus, related apertures 214 and 216 provide the 30 degree orientation for the third and fourth shafts. Extension 218 is at a 60 degree angle to end plate 126, and thus provides the second 30 degree rotation for the fifth and sixth shafts which are positioned through apertures 220 and 222, respectively. Lastly, outboard end plate extension 180 is provided with mounting flange 224 for bolting to the inboard end plate, is perpendicular to outboard end plate 126, and is provided with apertures 226 and 228 for the mounting of the seventh and eighth shafts, respectively.

Figure 7:
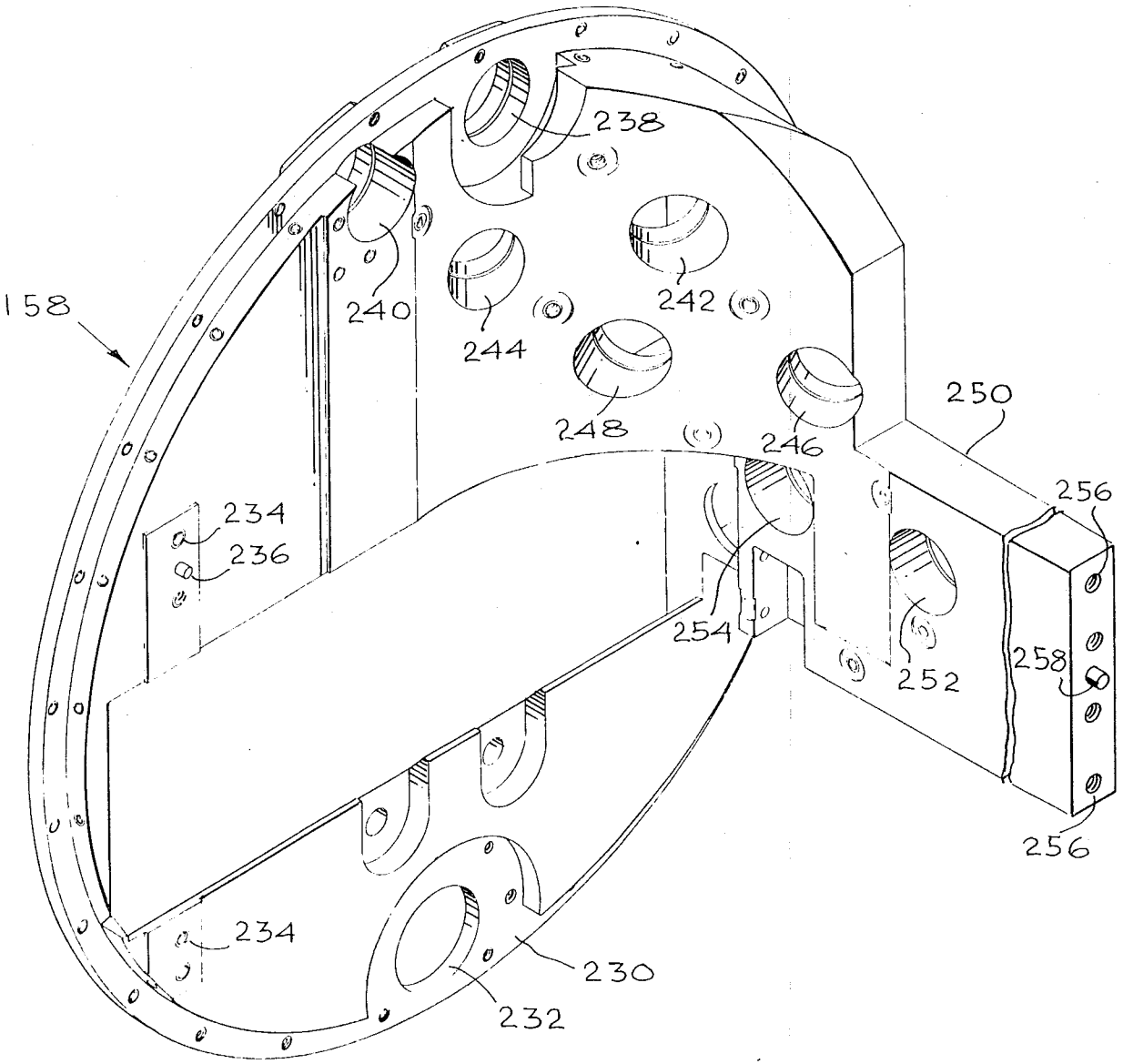
FIG. 7 is an isometric view of the inboard end plate, as shown in FIG. 5, looking inward.

Inboard end plate 158 is depicted in FIG. 7, looking inward, and is provided with recess mounting structure 230 for positioning of the hydraulic motor internal to the system, and with aperature 232 for the drive gear to drive the ring gear. Inboard end plate 158 is provided with bolt holes 234 which mate with and are used to bolt extension 224 of outboard end plate 126 shown in FIG. 6. Additionally dowel 236 is provided for alignment of the extension and the end plate. Inboard end plate 158 is provided with apertures 238 and 240 to complete the positioning of the first and second shafts, apertures 242 and 244 to position the third and fourth shafts, and apertures 246 and 248 to position the fifth and sixth shafts, respectively. Lastly, inboard end plate 158 is provided with an extension 250, corresponding to the outboard end plate extension, which contains apertures 252 and 254 for the seventh and eighth shafts, respectively. The extension further contains threaded bolt holes 256 for receiving bolts from the outboard end plate, and a guide dowel 258. Guide dowels 236 and 258, and the bolts are threaded through the end plates into extensions 180 and 250 after the shafts and related gears etc. are positioned. In this manner, the shafts and related structures are positively positioned.

Figure 8:
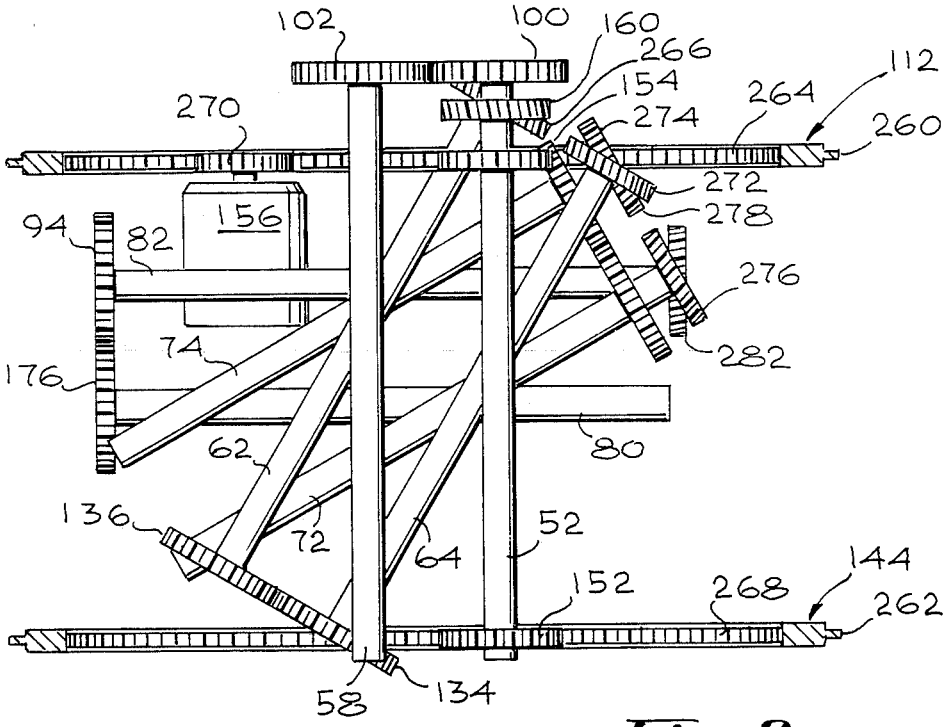
FIG. 8 is a schematic top view of the gear train of the preferred embodiment.

The gear train of the present invention is depicted in FIG. 8, in which inboard and outboard ring gears 112 and 144 are shown without the bearing surfaces, as provided in FIG. 5. Inboard ring gear 112 is provided with external teeth 260 and outboard ring gear 144 is provided with external teeth 262 which are used to drive chain ladder 28, as shown in FIG. 4. The ring gears are also provided with internal teeth 264 and 268, respectively, with inner ring gear 112 being driven by gear 270. Gear 270 is rotated by electric or hydraulic motor 156, which is controlled externally, and operated depending upon whether the transfer unit is to be operated. Additionally, motor 156 could be continuously operating and could be provided with, for instance, a magnetic or hydraulic clutch, which would engage gear 270 as needed. First shaft 52 is driven by inboard ring gear 112 through gear 154, and drives outboard ring gear 144 through gear 152. In this manner, balanced rotation of the unit is obtained during elevation and depression of the gun. Second shaft 58 is provided with gear 102, which is driven by gear 100, the furthest inboard gear on shaft 52. Between driven gear 154 and drive gear 100 on shaft 52 is helical gear 160 which drives fourth shaft driven gear 266, also a helical gear. Fourth shaft 62 and third shaft 64 are meshed at the outboard area through spur gears 136 and 134, respectively, with fourth shaft 62 driving third shaft 64. At the inboard end of third shaft 64, another helical gear 272 is provided to drive sixth shaft 74 through driven helical gear 274. Fifth shaft 72 is driven by spur gear 276 which meshes with drive spur gear 278 on sixth shaft 74. In a similar matter, eighth shaft 82 is provided with helical gear 282, which is meshed with fifth shaft helical gear 276 to continue the power train, and eighth shaft 82 is also provided, at its opposite end, with spur gear 94 which drives spur gear 176 on seventh shaft 80.

By virtue of this gearing arrangement, a counterclockwise rotation of gear 270, driven by motor 156, when looking relatively inboard, produces a counterclockwise rotation of ring gear 112. Ring gear 112 thus produces a counterclockwise rotation of first shaft drive gear 154, which transfers the same counterclockwise rotation to outboard ring gear 144 through gear 152. In this manner the system is torsionally balanced for rotation during operation, and both sides of the chain are driven synchronously. The same counterclockwise rotation on shaft 52 produces a clockwise rotation, through gears 100 and 102, of shaft 58, and draws the shells between the two shafts. Gear 160 on first shaft 52 produces the same clockwise rotation on fourth shaft 62, which, through gears 136 and 134, produces a counterclockwise rotation of shaft 64. Third shaft 64 then drives sixth shaft 74 in a clockwise direction, and thus the same pattern is followed through the whole of the transfer mechanism, that is, the first, third, fifth and seventh shafts rotate counterclockwise, and the second, fourth, sixth and eighth shafts rotate in a clockwise direction, and the shells are drawn between each of the pairs of shafts.

Figure 9:
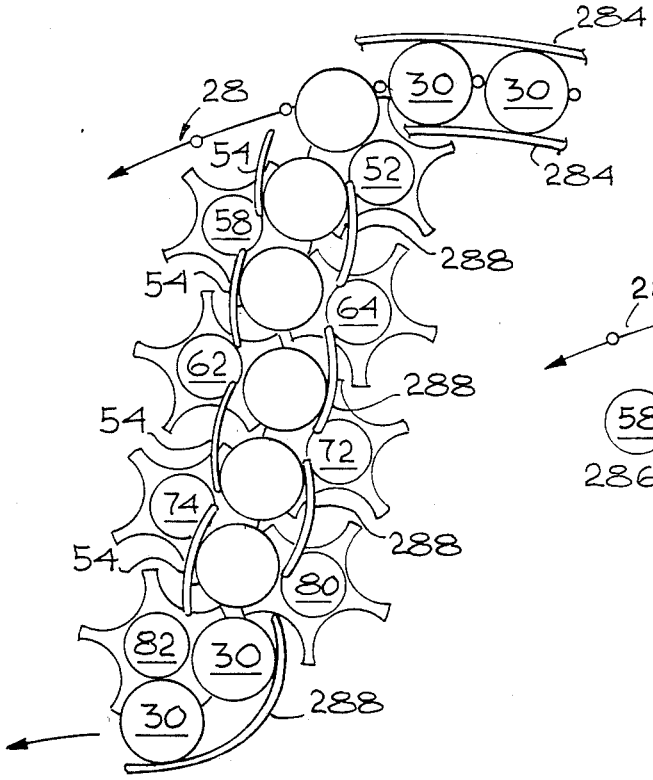
FIG. 9 is a schematic of the shell travel at one end of the unit.

The schematic drawing in FIG. 9 represents the outboard side of the transfer unit during operation, showing the path of the necks of the shells and can best be understood by consideration with FIG. 3. As can be seen in the drawing guides 284 help position shells 30 on chain ladder 28 until they reach, and are engaged by the sprockets on first shaft 52. The counterclockwise rotation of first shaft 52 then picks up a shell, and removes it from chain 28. The shell is then passed downward from the sprocket on shaft 52 to the sprockets of shafts 58, 64, 62, 72, 74, 80 and 82, in succession and the forward end of the shell moves forward (to the left in FIG. 9) as the shell is rotated. Additional security is provided by guides 288 and 54, shown schematically here, which assist in the positioning of the shells as they are pulled downward by the sprockets.

Figure 10:
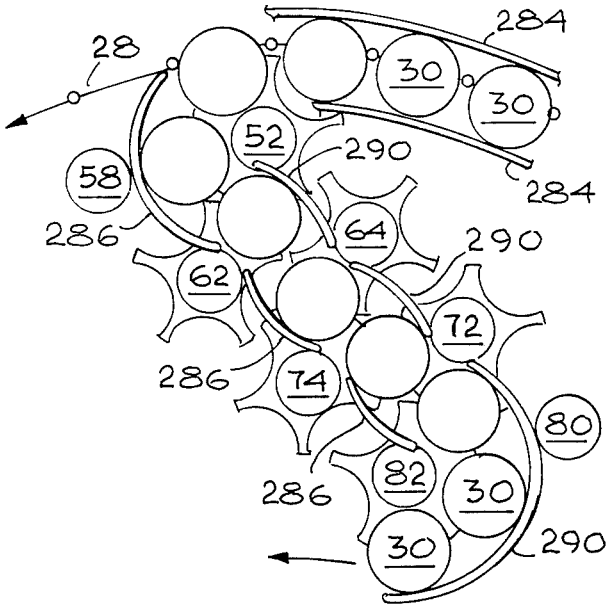
FIG. 10 is a schematic of the shell travel at the other end of the unit.

FIG. 10 shows the inboard end of the transfer unit, and clearly depicts the rearward movement of the bases of the shells as they are passed between the sprockets on the shafts and the guides in a downward direction, accomplishing the rotation indicated in FIG. 3. In this form, again, guide 284 cooperates with chain 28 to position shell 30, first adjacent to shaft 52 and its related sprocket, and then downward to contact the sprocket on fourth shaft 62, and then third shaft 64, followed by sixth shaft 74, fifth shaft 72 and lastly eighth shaft 82, respectively. As can be seen, guide 286 makes the provision of sprockets on second shaft 58 unnecessary, but they may be provided for further security, if desired. Additionally, guide 290 performs the same function for shaft 80, but a sprocket may be provided.

Figure 11:
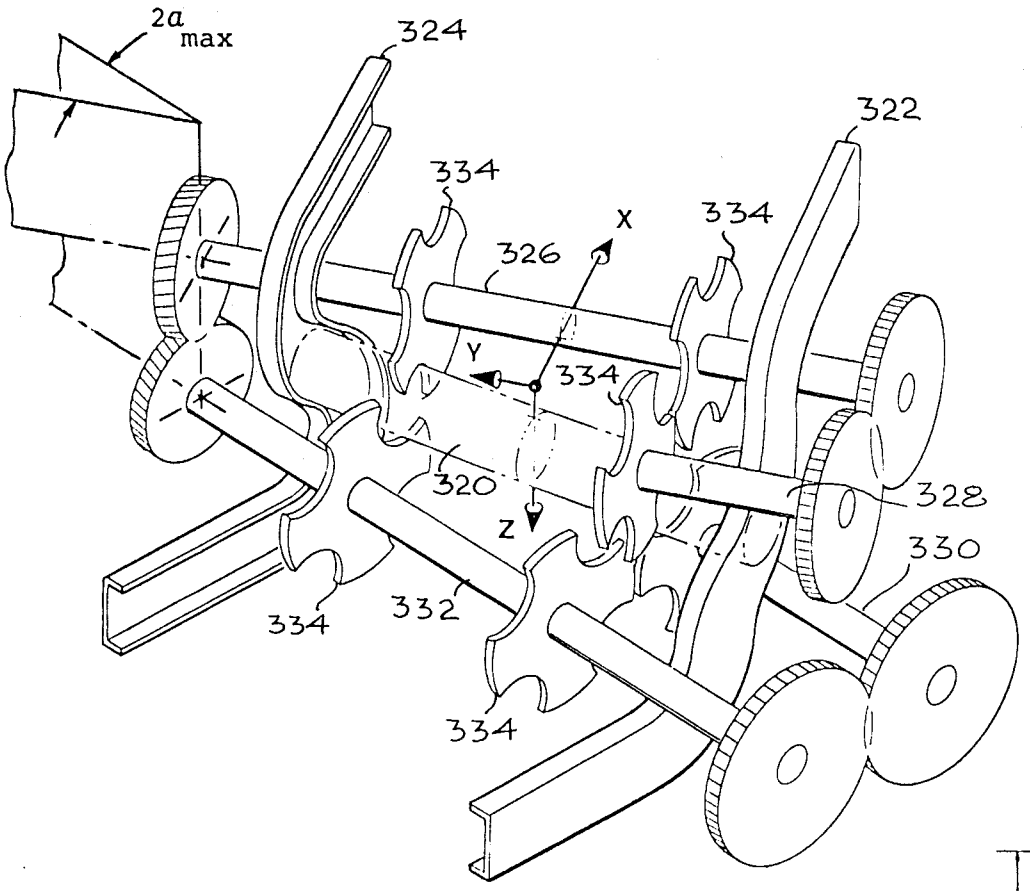
FIGS. 11, 12 and 13 are schematic drawings illustrating the mathematical factors involved in designing the apparatus of the present invention.
Figure 12:
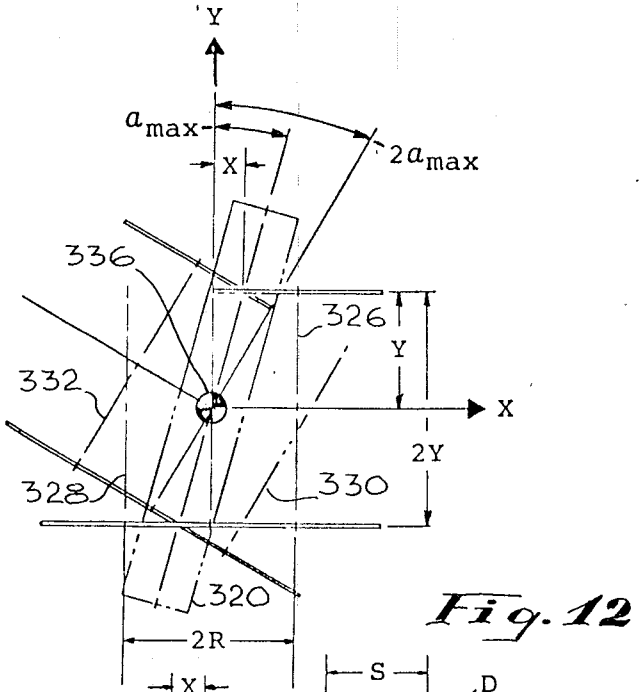
Figure 13:
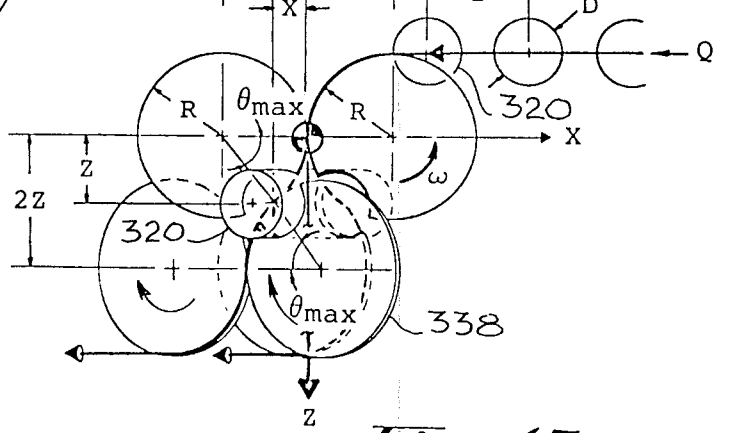

The schematics of FIGS. 11, 12, and 13 are utilized to define the parameters necessary to design a transfer unit in accordance with the present invention. In these figures, a shell 320 is shown positioned between guides 322 and 324 and being moved from contact with first shaft 326 and second shaft 328 to contact with third shaft 330 and fourth shaft 332 by their attached sprockets 334. At the left side of FIG. 11 the angle indicated by the arrows on the extended planes is defined by a plane perpendicular to the plane produced by shafts 330 and 332 along the axis of shaft 332, meeting a plane perpendicular to the plane defined by shafts 326 and 328 and along the axis of shaft 326. This angle is used to define the amount of re-orientation ($2\alpha$ max) as will be described hereinbelow.

FIG. 12 is a relatively vertical view showing the four shafts of FIG. 11 as lines with their attached sprockets and shell 320 as the broken line resting half way between the full rotation obtained by one step. The full rotation is shown by the arrows in the upper part of the drawing, and the access defined by the small circle 336 in the center portion of the drawing is positioned half the distance between the contact points of the sprockets on the shell.

In FIG. 13, an end view showing the sprockets as circles 338, shell 320 in several positions and the rotation of the sprockets is provided.

Referring to FIGS. 11 and 12, which present the typical geometery and defining parameters for a single twist stage, it can be seen that the mechanism is symmetrical and repetitive. The upper and lower shafts and sprocket pairs are identical, the pairs being rotated about the "Z" axis, as shown in FIG. 11, through an angle equal to the angle shown at the left of FIG. 11. It should be noted that this illustration is only for one stage and additional stages, as desired, may be provided. When plural stages are provided, the lower set of shafts and sprockets becomes the upper stage for the second calculation. Normally, in designing this type of equipment, the space between each item, the feed rate for items or shells, diameter of the item, and the total rotation or twisting required (in radians) are given as advance requirements. The number of stages is then selected, which determines the twist per stage ($2\alpha$ max), keeping in mind that it is desirable to limit the twist per stage to 45 degrees or less. Though generally, a minimum of four sprocket positions is desired, the number may be varied and should be selected next. In order to provide continuity of feed, the sprocket pitch radius and speed are then determined by using the equations:

$$R = Sn/2\pi \quad (1)$$

$$W = 2\pi Q/n \quad (2)$$

where R is the sprocket pitch radius in inches, S is the item spacing in inches, n is the number of item positions on the sprocket, W is the sprocket speed in radians per second and Q is the item feed rate in items per second. At this point, the designer would be left with four variables to select from: i.e. offset at transition point, sprocket axial spacing, stage spacing, and the transition angle. However, the selection of these variables must satisfy the following equations:

$$X/Y=\tan(\alpha \max) \text{ (geometry)} \quad (3)$$

$$X=R[1-\cos(\theta \max)] \text{ (position continuity)} \quad (4)$$

$$Z=R \sin(\theta \max) \text{ (position continuity)} \quad (5)$$

where X is the offset at the transition point in inches, Y is the sprocket axial spacing in inches, Z is the stage spacing in inches, and $\theta$ max is the transition angle in radians. It should be noted that the velocity continuity is also automatically satisfied by the symmetry, and that angular acceleration is discontinuous at the transition point. Thus, since the designer is faced with 3 equations in 4 unknowns, only one variable may be arbitrarily selected. Selection of this variable must be tempered by gear train considerations, shaft size requirements, envelope restrictions, load and power requirements, guide channel complications, etc. However, it is usually preferable to select either Z or Y as the variable, letting X and $\theta$ max be determined by the calculations. Additionally, care must be taken to assure that item to item interference does not occur during transition. This requirement, for constant diameter items, is:

$$Z-R\{\sin(\theta \max)-\sin[(\theta \max)-\pi/n]\} \geqq D/2 \quad (6)$$

wherein each of the letters and numbers is defined as above, and D is the item diameter in inches. Having completed this procedure, the design is determined by utilizing the above derived material to calculate the item vertical position in inches, the vertical velocity in inches per second, the vertical acceleration in inches per second squared, the angular position in radians, the angular velocity in radians per second and the angular accelerations in radians per second squared. In these calculations, the angle $\theta$ should be between 0 and the maximum amount as previously defined, preferably no more than 22.5 degrees.

The resulting data is then used to generate the profile of the required guide surfaces and geometry of the sprockets. The sprocket shell loading pockets must be slightly ellipsoidal in contour, for cylindrical feed systems, and the severity of the ellipsoid is determined by the twist per stage ($2\alpha$ max). The load and power analysis should then be completed, as determined by the system geometry and dynamics, and such other factors as item characteristics and estimated coefficients of friction. In this manner then, the transfer unit internal structure may be designed properly.

Although there have been described above specific arrangements of a transfer unit for feeding a rapid fire gun, in accordance with the invention, for the purposes of illustrating the manner in which the invention may be used to advantage, it will be appreciated that the invention is not limited thereto. For example, although the invention has been disclosed in the context of association with the re-orientation of shells to be fired from a gun, the principles of the invention are equally applicable to, for example, re-orientation of soft drink or other liquid-containing bottles and the like. Accordingly, any and all modifications, variations or equivalent arrangements which may occur to those skilled in the art should be considered to be within the scope of this invention, as defined in the appended claims.

I claim:

1. A transfer unit for axial re-orientation of a plurality of linkless feed items following in succession comprising:

a support frame which is rotatable about a central axis under the control of an associated rotatable utilization means, the support frame being rotatable with the utilization means about coincident axes of rotation;

a first shaft rotatably mounted in said frame;

means for positively engaging said items for rotation about the axis of said shaft;

at least a second shaft rotatably mounted in said frame non-coplanar with said first shaft and oriented at a selected angle to said first shaft;

means for receiving said items from said first shaft and positively engaging them for rotation about said second shaft;

means for introducing said items individually in succession to said frame at an entry position rotatable with said frame, the introduced items having a first axial orientation generally parallel to said central axis, and delivering the items to the positively engaging means for rotation about said first shaft; and means for discharging said items from said frame with a second axial orientation aligned in a plane generally perpendicular to said central axis, said second axial orientation being rotatable in said plane with the rotation of the support frame and the utilization means;

wherein said positively engaging means comprise sprockets mounted on said shafts.

2. A transfer unit for axial re-orientation of a plurality of linkless feed items following in succession comprising:

a support frame which is rotatable about a central axis under the control of an associated rotatable utilization means, the support frame being rotatable with the utilization means about coincident axes of rotation;

a first shaft rotatably mounted in said frame;

means for positively engaging said items for rotation about the axis of said shaft;

at least a second shaft rotatably mounted in said frame non-coplanar with said first shaft and oriented at a selected angle to said first shaft;

means for receiving said items from said first shaft and positively engaging them for rotation about said second shaft;

means for introducing said items individually in succession to said frame at an entry position rotatable with said frame, the introduced items having a first axial orientation generally parallel to said central axis, and delivering the items to the positively engaging means for rotation about said first shaft;

means for discharging said items from said frame with a second axial orientation aligned in a plane generally perpendicular to said central axis, said second axial orientation being rotatable in said plane with the rotation of the support frame and the utilization means; and motor means having a drive gear coupled to drive the first shaft in rotation.

3. The apparatus of claim 2 comprising a gear train including the motor drive gear and additional gears coupled between the first shaft and all subsequent shafts, the first shaft being positioned in said gear train between the motor drive gear and the gearing to all subsequent shafts.

4. The apparatus of claim 2 further including gearing means coupled between the motor drive gear and the item introducing means for driving the introducing means in synchronism with the rotation of the shafts.

5. The apparatus of claim 4 wherein said gearing means comprises a pair of ring gears supported by bearings at opposite ends of the support frame for rotation independent of the position of the support frame, one of said ring gears being coupled to the motor drive gear.

6. A transfer unit for re-orienting the axes of a plurality of sequential items comprising:

a support frame which is rotatable about a central axis under the control of an associated rotatable utilization means, the support frame being rotatable with the utilization means about coincident axes of rotation;

a first pair of item receiving shafts mounted in said frame for receiving items delivered in sequence to said frame and being synchronously rotatable to pass said items between said shafts;

means for positively engaging said items as they pass between the shafts;

at least a second pair of shafts mounted in said frame and being synchronously rotatable with said first pair of shafts to pass said items between said at least second pair of shafts, said at least second pair of shafts being non-coplanar with said first pair of shafts and oriented at an angle different from said first pair of shafts, said first and second pairs of shafts being mounted for rotation with the support frame;

means for receiving said items from said first pair of shafts and passing said items around and between said second pair of shafts; and means for discharging said items from said frame with an axial orientation different from that in which the items are delivered to the frame, the axial orientation of the items discharged from the frame being aligned in a plane generally perpendicular to said central axis, the axial orientation of the items on discharge being rotatable in said plane with the rotation of the support frame and the utilization means.

7. The apparatus of claim 6 further including motor means having a drive gear coupled to drive one of the first pair of shafts in rotation.

8. The apparatus of claim 7 comprising a gear train including the motor drive gear and additional gears coupled between the first driven shaft and all subsequent shafts, the first driven shaft being positioned in said gear train between the motor gear and the gearing to all subsequent shafts.

9. The apparatus of claim 7 further including gearing means coupled between the motor drive gear and the item introducing means for driving the introducing means in synchronism with the rotation of the shafts.

10. The apparatus of claim 9 wherein said gearing means comprises a pair of ring gears supported by bearings at opposite ends of the support frame for rotation independent of the position of the support frame, one of said ring gears being coupled to the motor drive gear.

11. The apparatus of claim 6 wherein said frame central axis is generally parallel to the axis of said first pair of shafts.

12. A transfer unit for the re-orientation of plural items comprising:

a housing;

re-orientation means within said housing;

means for feeding said plural items in said housing to the re-orientation means;

means independent of said re-orientation means to rotate said re-orientation means about an axis parallel to said items when in said housing;

a plurality of spaced-apart paired shafts synchronously rotatable with said re-orientation means and acting therewith to re-orient said items perpendicular to the axis of the items in the housing, and perpendicular to rotation of the re-orientation means; and means for positively engaging said items, for sequentially passing them between each pair of shafts;

wherein the re-orientation means includes at least one shaft.

13. The apparatus of claim 12 wherein said shafts and said re-orientation means comprise four pairs of shafts.

14. The apparatus of claim 12 further comprising guide means positioned adjacent to said shaft effective to guide the items between the shafts.

15. Transfer apparatus for re-orienting the axes of a plurality of linkless feed items following in succession comprising, in combination:

a housing;

a feed mechanism for introducing the items into the housing in generally parallel alignment with a first axial orientation;

a discharge mechanism for removing the items from the housing in generally parallel alignment with a second axial orientation displaced by a selected angle from the first orientation; and a plurality of sprocket shafts intercoupled for rotation in synchronism and aligned at respective angles of orientation in different planes along a transfer path between the feed and discharge mechanisms for individually engaging the items, rotating them partially about each shaft, and pivoting them through a portion of the selected angle between the first and second orientations; the housing including rotatable means for supporting the feed mechanism, the discharge mechanism and the sprocket shafts for rotation relative to the housing about an axis parallel to the first orientation so that the discharge mechanism may remove the items from the housing with the second axial orientation assuming any of a range of directions defining an output plane perpendicular to the first orientation.

16. The apparatus of claim 15 further comprising a motor coupled to drive the shafts and the feed and discharge mechanisms in synchronism.

17. The apparatus of claim 16 wherein the shafts and the feed and discharge mechanisms are operable in either direction and the motor is selectively reversible for changing the direction of movement of the items along the transfer path.

18. The apparatus of claim 15 further comprising a pair of opposed guide members arranged along the transfer path for guiding the opposite ends of the items moving along the transfer path.

19. The apparatus of claim 15 wherein each sprocket shaft has respective sprocket recesses for individually receiving the items in positive engagement and advancing them along the transfer path.

20. The apparatus of claim 15 wherein the housing includes a rotatable drum in which the feed mechanism introduces the items at the periphery of the drum and the discharge mechanism removes the items along the central axis of the drum.

21. The apparatus of claim 20 wherein the shafts are mounted within the drum for rotation therewith while being driven to propel the items along the transfer path.

22. The apparatus of claim 21 wherein the discharge mechanism is aligned to remove the items from the housing at a fixed angle of alignment relative to the end of the drum, irrespective of the angle of rotation of the drum.

23. The apparatus of claim 20 wherein the drum includes a pair of ring gears for driving the feed mechanism.

24. The apparatus of claim 20 wherein the drum includes a pair of ring gears for driving the feed mechanism and further including a motor coupled to drive one of the ring gears which in turn drives one of the shafts to drive the remaining shafts and the other ring gear in synchronism.

25. The apparatus of claim 24 wherein a first one of the shafts is driven by one of the ring gears and each of the remaining shafts is driven by a shaft adjacent to it through a gear train extending from the first shaft.

26. The apparatus of claim 15 wherein the shafts are oriented by pairs, each pair being oriented at an angle relative to an adjacent pair along the transfer path.

27. The apparatus of claim 26 wherein the angle between the first and second orientations is approximately 90° and there are three pairs of shafts, each pair being oriented at 45° to an adjacent pair.

28. The apparatus of claim 26 wherein the angle between the first and second orientations is approximately 90° and there are four pairs of shafts, each pair being oriented at 30° to an adjacent pair.

29. The apparatus of claim 15 wherein the shafts are intercoupled by gears for driving the shafts in synchronism.

30. A transfer unit for axial re-orientation of a plurality of linkless feed items following in succession comprising:

a support frame which is rotatable about a central axis under the control of an associated utilization means;

a first shaft rotatably mounted in said frame;

means for positively engaging said items for rotation about the axis of said shaft;

at least a second shaft rotatably mounted in said frame non-coplanar with said first shaft and oriented at a selected angle to said first shaft;

means for receiving said items from said first shaft and positively engaging them for rotation about said second shaft;

means for introducing said items to said frame with a first axial orientation generally parallel to said central axis and delivering the items to the positively engaging means for rotation about said first shaft;

means for discharging said items from said frame with a second axial orientation aligned in a plane generally perpendicular to said central axis, said second axial orientation being rotatable in said plane with the rotation of the support frame as controlled by the utilization means; and at least a third shaft, non-coplanar with said first shaft or said second shaft, and oriented at a selected angle different from the orientation of said first shaft and said second shaft, and having means for receiving items from said second shaft and means for positively engaging said items for rotation about said third shaft.

31. The apparatus of claim 30 further comprising, a fourth shaft non-coplanar with any of said first, second or third shafts, and further means for receiving items from said third shaft and means for positively engaging said items for rotation about said fourth shaft.

32. A transfer unit for re-orienting the axes of a plurality of sequential items comprising:

a support frame which is rotatable about a central axis under the control of an associated utilization means;

a first pair of item receiving shafts mounted in said frame for receiving items delivered in sequence to said frame and being synchronously rotatable to pass said items between said shafts;

means for positively engaging said items as they pass between said shafts;

at least a second pair of shafts mounted in said frame and being synchronously rotatable with said first pair of shafts to pass said items between said at least second pair of shafts, said at least second pair of shafts being non-coplanar with said first pair of shafts and oriented at an angle different from said first pair of shafts;

means for receiving said items from said first pair of shafts and passing said items around and between said second pair of shafts;

means for discharging said items from said frame with an axial orientation different from that in which the items are delivered to the frame, the axial orientation of the items discharged from the frame being aligned in a plane generally perpendicular to said central axis, the axial orientation of the items on discharge being rotatable in said plane with the rotation of the support frame as controlled by the utilization means; and at least a third pair of shafts synchronously engaged with the other shafts, and means for positively receiving said items from said second pair of shafts and passing said items between said pairs of shafts and about the axis of one of said third pair of shafts, wherein said third pair of shafts is non-coplanar with said first pair and said second pair of shafts and is oriented at an angle different from the orientations of said first pair of shafts and said second pair of shafts.

33. The apparatus of claim 32 further comprising guide means positioned about said shafts effective to guide said items between said shafts.

34. The apparatus of claim 32, further comprising a fourth pair of shafts non-coplanar with said first, second and third pairs of shafts and oriented at an angle different from said first, second and third pairs of shafts; and means for positively engaging said items, receiving said items from said third pair of shafts, and transporting said items about the axis of one of said fourth pair of shafts.

* * * * *